United States Patent [19]

McQuade, Sr.

[11] Patent Number: 4,691,541

[45] Date of Patent: Sep. 8, 1987

[54] GATE LOCKING DEVICE

[76] Inventor: Donald E. McQuade, Sr., 1935 N. Railroad Ave., Staten Island, N.Y. 10306

[21] Appl. No.: 864,643

[22] Filed: May 15, 1986

[51] Int. Cl.[4] ..... E05C 3/14

[52] U.S. Cl. ..... 70/77; 292/207; 292/218; 292/238; 292/DIG. 13

[58] Field of Search ..... 70/77, 451; 292/DIG. 13, 205, 207, 213, 218, 238

[56] References Cited

U.S. PATENT DOCUMENTS

| | | | |
|---|---|---|---|
| 303,225 | 8/1884 | Jordan | 292/218 |
| 1,319,187 | 10/1919 | Summers | 292/238 |
| 2,074,759 | 3/1937 | Richards | 292/DIG. 13 X |
| 2,194,408 | 3/1940 | Sluss | 292/DIG. 13 X |
| 2,666,660 | 1/1954 | Youngworth | 292/205 X |
| 2,809,063 | 10/1957 | Taylor | 292/218 |
| 3,270,536 | 9/1966 | Sprung | 292/207 X |
| 3,307,384 | 3/1967 | Sinervo | 70/451 |
| 3,702,549 | 11/1972 | Solovieff et al. | 70/451 X |
| 3,926,018 | 12/1975 | Joersz | 70/14 X |
| 3,934,436 | 1/1976 | Candlin et al. | 70/234 |
| 4,387,916 | 6/1983 | Lening et al. | 292/205 X |
| 4,592,578 | 6/1986 | Martin | 292/40 |

FOREIGN PATENT DOCUMENTS

| | | | |
|---|---|---|---|
| 584589 | 11/1924 | France | 70/18 |

*Primary Examiner*—Robert L. Wolfe
*Assistant Examiner*—Lloyd A. Gall
*Attorney, Agent, or Firm*—Pennie & Edmonds

[57] ABSTRACT

A gate lock of the oarlock type having a locking member fixed to a collar at the end of the collar having the oarlock hingeably mounted thereto. The lock member is a push button lock having a lock bar which extends to engage the oarlock to hold it in the locked position. The lock member always remains fixed to the device in an operable position so the lock may easily be engaged.

8 Claims, 8 Drawing Figures

GATE LOCKING DEVICE

BACKGROUND

1. Field of the Invention

The invention relates to latches for securing doors and in particular to a child proof gate lock for chain link fences.

2. Description of Related Art

Chain link fences are made of a support frame of pipe. The frame supports a mesh of thick metal wire which forms a screen. The screen is held to the frame by pieces of wire surrounding the frame work at fixed intervals. To provide a gate in an opening of a chain line fence, a pipe work frame the size of the opening is hinged to one side of the opening. An oarlock is hingeably attached to the opposite side of the gate frame. When the gate is in the closed position, the oarlock is moved to a horizontal position where it receives a pole of the fence in a U-shaped portion.

Locking the gate requires that openings be provided in the oar lock and the collar holding the oar lock. When the oar lock is in the closed position, the openings line up and a padlock is passed through the openings to hold them in their aligned position. With the lock in place, the oar lock cannot be moved from its horizontal locking position to its vertical open position. Thus the gate is locked.

The drawbacks of the padlock method include difficulty in operation and the potential to lose or misplace the lock. This loss occurs frequently because the padlock has to be removed from the gate to complete the locking and unlocking operation. In order to complete the unlocking two hands must be used. One hand to hold and steady the lock, while the other hand is inserting the key to open the lock.

SUMMARY OF THE INVENTION

The invention eliminates the risk of losing or misplacing the lock because the device is always attached to the gate frame. At no time is it removed from the gate to complete its operation. Operational ease is attained because the lock is stationary and the key slot is accessible. To open the lock all that is necessary is to insert the key and turn. When the key is turned, the lock cylinder will pop out and release the lock bar from the oar lock.

To lock the gate, the oar lock is merely moved to its horizontal, locking position and a push button cylinder is engaged to move its lock bar into an opening in the oarlock to fix the oar lock in position.

The collar holding the lock and oarlock is modified to improve its performance. The collar is in two pieces and sandwiches the pipe of the gate frame. A pair of set screws reduces the risk of the collar rotating. The set screws pass through the collar to engage the frame pipe. Advantageously the set screws may engage openings in the pipe to provide additional strength against rotation.

Four carriage bolts are used to secure the collar in its sandwiching position. This provides additional strength to the unit above that known in prior units.

The lock system is comprised of several parts. Each of the parts is easily replaceable thus permitting quick and easy repair to the system.

The lock provides a child proof gate lock with ease of installation. The lock is always in its proper locking position and cannot be misplaced.

DESCRIPTION OF THE PREFERRED EMBODIMENT

Figure 1:
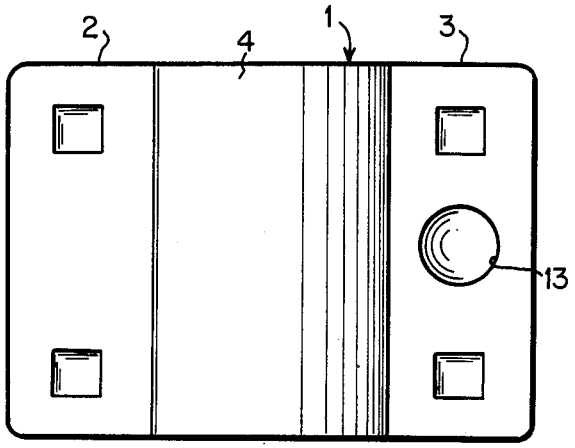
FIG. 1 is a plan view of the front piece of the collar of the invention.
Figure 2:
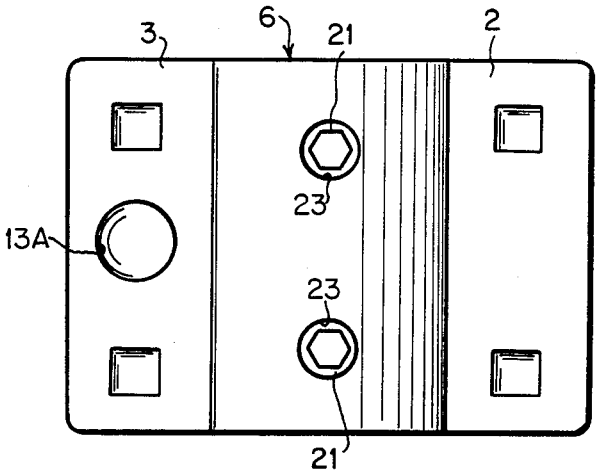
FIG. 2 is a plan view of the back piece of the collar of the invention.
Figure 7:
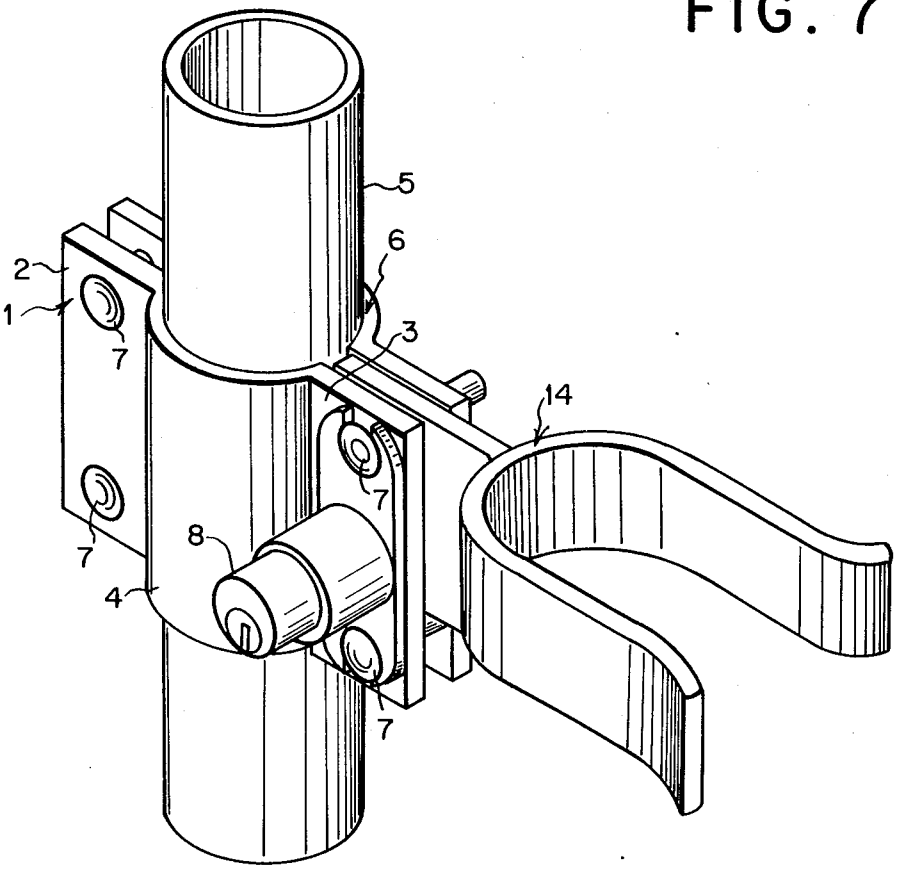
FIG. 7 is a front perspective view of the device of the invention.
Figure 8:
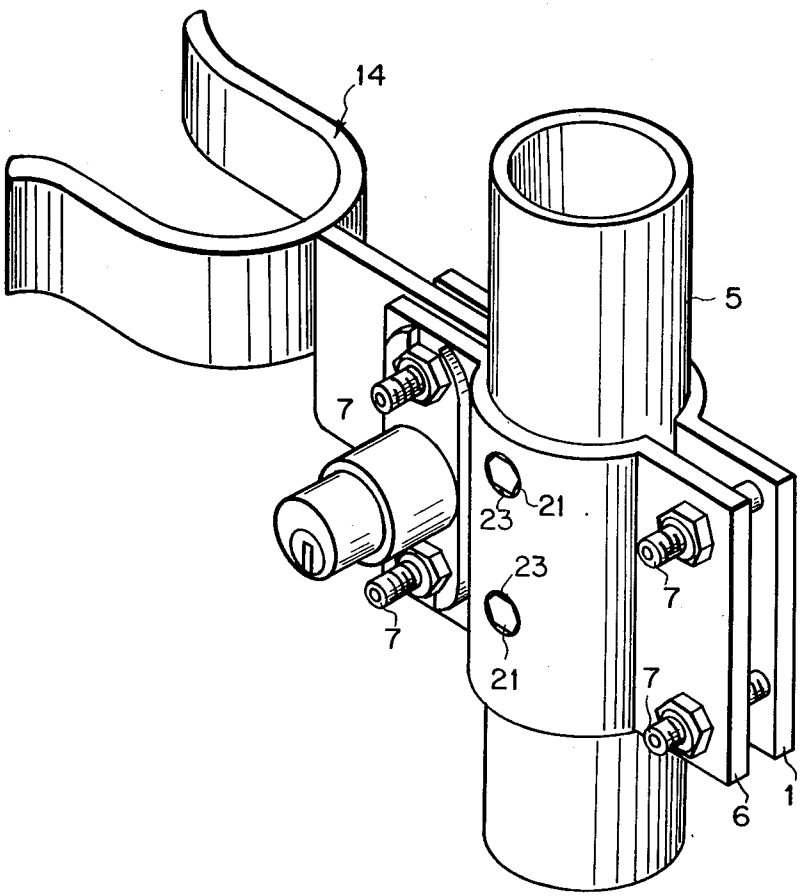
FIG. 8 is a rear perspective view of the device of the invention.

Referring to FIGS. 1 and 2 there is shown the collar of the invention. The front piece 1 of FIGS. 1 and 7 has two co-planar end portions 2,3 and a curved connecting portion 4. The radius of curvature of connecting portion 4 is substantially the same as the outside curvature of pipe 5. pipe 5 is either on a gate to be secured or on the frame of the fence at the opening in which the gate is mounted.

Front piece 1 is biased toward back piece 6 via biasing means such as four carriage bolts 7. The front piece 1 and back piece 6 bolt together to form a collar which sandwiches and clamps to Pipe 5.

Figure 3:
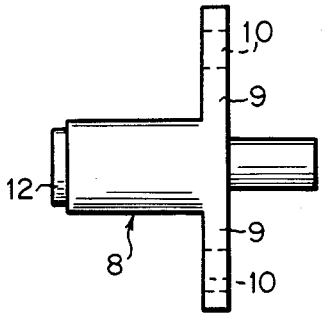
FIG. 3 is a side view of the locking mechanism of the present invention in the locked position.
Figure 4:
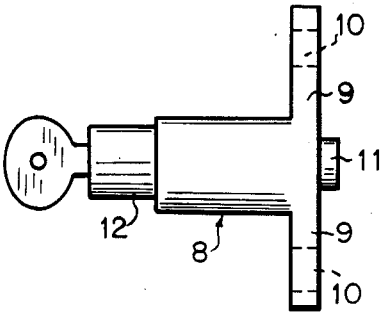
FIG. 4 is a side view of the locking mechanism of FIG. 3 in the unlocked position.
Figure 5:
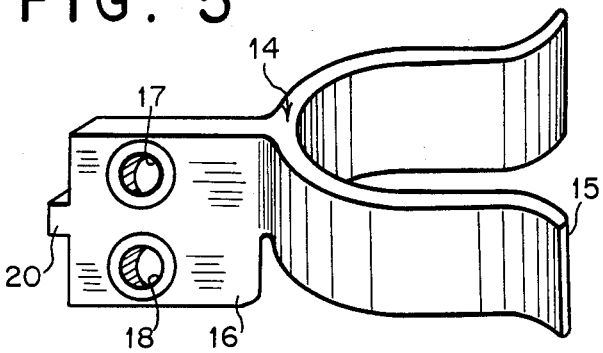
FIG. 5 is a perspective view of the oar lock of the assembly.

A lock member 8, FIGS. 3 and 4 is mounted to either the front piece 1, the back piece 6 or both through two of the carriage bolts 7. The lock member 8 has a flange 9 extending from either side of a first end. The flange 9 defines bolt holes 10 for receiving carriage bolts 7 in the assembled position. The lock member 8 has a lock bar 11 which extends from the locking member 8 when the lock 12 is pushed to the locking position. Lock bar 11 extends through openings 13, 13A in the front and back pieces 1 and 6, FIGS. 1, 2 and 6.

An oar lock 14 is hingeably attached to the collar. The oar lock 14 has a forked end 15 for receiving a further pipe to hold the gate closed, in a known manner. The oar lock 14 has a hinge plate 16 formed opposite fork 15. The hinge plate 16 defines two openings, a pivot opening 17 and locking opening 18. The top carriage bolt on the end of the collar having locking member 8 is passed through a spacer 17A which is positioned in pivot opening 17 when the oar lock 14 is positioned between the front and back pieces of the collar. In order to prevent binding of the oar lock 14 by clamping front piece 1 and back piece 6 too close together, a spacer 19 is provided around the lower carriage bolt. The spacers 17A, 19 permit tight clamping of the collar while preventing binding of the collar about the bar lock. An alignment extension 20 extends from the back of oar lock 14 to abut pipe 5 when the oar lock is in the closed position shown in FIG. 7. Locking opening 18 is thereby aligned with openings 13, 13A. In this manner, a lock bar may be pushed through opening 13, locking opening 18 and opening 13A to secure the oar lock in the closed position thus preventing opening of the gate.

In order to further secure the device, set screws 21 are received in threaded openings 23 defined by back piece 6. The set screws 21 may be screwed in to provide additional clamping force against pipe 5 to prevent rotation of the device. Alternatively, the screws may engage corresponding openings in the pipe.

Figure 6:
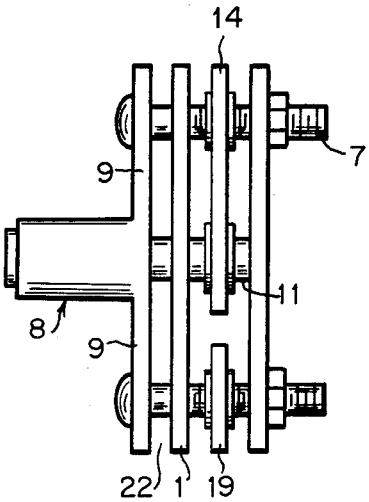
FIG. 6 is an end view of the assembled device with the parts slightly space for clarity.

FIG. 6 shows a partial cross-sectional view with the pieces separated slightly to show their relative positions. Front piece 1 has lock member 8 mounted to it. The hinge plate 16 of oarlock 14 is positioned between front piece 1 and back piece 6. A carriage bolt 7 passes through the lower part of lock member 8, front piece 1, back piece 6 and a spacer 19. When the unit is clamped, space 22 will disappear as lock member 8 and front piece 1 are held in tight face-to-face contact.

I claim:

1. A gate locking device in combination with a first pipe of a gate closure of a chain link fence, the fence is of the type having a support framework with an overlay of interwoven wire, the fence having an opening defined by a pipework frame with a gate mounted hingeably therein at one side for closing said opening, the frame including said first and a second pipe, said device comprising:

(a) a collar formed by a front piece and a back piece clamped to a first pipe opposite the hinged connection of said gate;

(b) a lock member fixed to a face of one of said front piece and said back piece, said lock member having a lock bar translatable in a line perpendicular to said face;

(c) an oar lock hingeably attached to said collar, movable between a first position where said gate is unlocked and a second position where said oarlock receives a second pipe, adjacent to said first pipe when said gate is in a closed position, within a forked shape portion of said oarlock to prevent relative movement of said first and second pipe in a direction perpendicular to the plane of said gate and thereby prevent opening said gate; and (d) a plate portion of said oarlock defining a locking opening for receiving said lock bar when said oarlock is moved to the second position and said lock bar is moved to a locking position to thereby prevent hinged movement of said oarlock and lock the gate.

2. The gate locking device according to claim 1 wherein:

(a) the front piece and back piece each have a pair of flanges extending from a central partial cylinder; and, (b) the front piece and back piece are positioned in spaced face to face relation to define a cylindrical opening by said central partial cylinders to receive therein said first pipe and clamp therearound by biasing means biasing the flanges of each of the front and back piece toward the flanges of the other.

3. The gate locking device according to claim 2 wherein:

(a) each of said flanges defines two openings which align with openings in the flange of the other piece; and, (b) a bolt is received through each of the openings of one flange and also the opening of the opposed flange which is aligned therewith to thereby bias said flanges toward one another when a nut received on said bolt is tightened down on one of said flanges.

4. The gate locking device according to claim 3 wherein:

(a) said lock member has a pair of oppositely extending flanges which each define a mounting opening, the separation of said mounting openings is equal to the separation of the openings defined by the flanges at the end of said collar which has said oarlock mounted thereto, and said mounting openings receive said bolts to mount said lock member to one of said flanges.

5. The gate locking device according to any one of the claims 1–4 wherein:

(a) at least one threaded opening is defined in one of said front piece and back piece; and, (b) a set screw is threadedly received in each of said at least one threaded opening to engage said first pipe to fix said collar against rotation about said first pipe.

6. The gate locking device according to any one of the claims 1–4 wherein:

(a) a lock-bar opening is defined in one of said front piece and said back piece, said lock bar opening is positioned to permit said lock bar to move through said opening and engage said oarlock.

7. The gate locking device according to claim 6 wherein:

(a) a second lock bar opening is defined by the other of the front piece and back piece to receive said lock bar once it engages and passes through said oarlock.

8. The gate locking device according to claim 6 wherein:

(a) an alignment extension extends from the side of said oarlock opposite the fork-shaped portion, to abut said first pipe when said oarlock is moved to said second position, thereby holding said oarlock in a position aligning said lock bar opening and an opening in said oar lock for receiving said lock bar in its locking position.

* * * * *